United States Patent [19]

Nenno et al.

[11] 4,019,925

[45] Apr. 26, 1977

[54] METAL ARTICLES HAVING A PROPERTY OF REPEATEDLY REVERSIBLE SHAPE MEMORY EFFECT AND A PROCESS FOR PREPARING THE SAME

[75] Inventors: Soji Nenno, Suita; Kazuyuki Enami, Itami, both of Japan

[73] Assignee: Osaka University, Osaka, Japan

[22] Filed: Apr. 7, 1975

[21] Appl. No.: 565,671

[30] Foreign Application Priority Data

May 4, 1974 Japan ..... 49-49901

[52] U.S. Cl. ..... 148/2; 148/11.5 R; 148/11.5 N; 148/32

[51] Int. Cl.[2] ..... C22F 1/10

[58] Field of Search ..... 148/11.5 R, 13, 32, 148/2, 11.5 N; 75/170

[56] References Cited

UNITED STATES PATENTS

| | | | |
|---|---|---|---|
| 3,594,239 | 7/1971 | Wang | 148/13 |
| 3,783,037 | 1/1974 | Brook et al. | 148/11.5 R |
| 3,832,243 | 8/1974 | Donkersloot et al. | 148/32 |

OTHER PUBLICATIONS

Memory Effect in Ni–36.8 At. Pct Al Martensite; Enami et al.; Metallurgical Transactions; vol. 2, May 1971. pp. 1487–1490.

*Primary Examiner*—W. Stallard

[57] ABSTRACT

Metal articles having a property of repeatedly reversible shape memory effect and a process for preparing the same comprising applying deformation stress to a $\beta$-brass type martensitic alloy.

25 Claims, 3 Drawing Figures

METAL ARTICLES HAVING A PROPERTY OF REPEATEDLY REVERSIBLE SHAPE MEMORY EFFECT AND A PROCESS FOR PREPARING THE SAME

The present invention relates to metal articles having a repeatedly reversible shape memory effect and a process for preparing the same, and especially to Ni—Al and Ni—Al—CO alloys suitable for preparing the abovementioned metal articles and a process for preparing the same.

It is known that certain kinds of alloys have a property of providing a heat shape memory effect or a characteristic of deforming articles comprising the said alloys in a predetermined range of temperature after heat treating the articles and then regaining the original shape by heating the alloys above a predetermined temperature. It is also known that the said effect appears in association with a change from a low temperature phase to a high temperature phase, and that the said effect is found in β-brass type electron compound alloys e.g. Ni—Ti, Au—Cd, Ag—Cd, Cu—Zn, and Cu—Al and iron-base solid solution alloys e.g. Fe—Ni, Fe—Ni—Cr and 18—8 stainless steel. The said effect found in the conventionally known metal articles are, however, irreversible or unidirectional (that is, once the deformation is annihilated out by heating at a certain temperature, the articles cannot regain the deformed shape by successive cooling), and therefore it has been impossible to repeatedly produce the said effect.

Further, in the conventional metal articles the said effect is insufficient, that is, undeformed and deformed shapes are not perfectly regained, so that such articles are limitedly applied to some industrial uses only.

The present invention is based on the inventors' following views.

a. Metal articles having a repeatedly reversible shape memory effect can be prepared by subjecting β-brass type martensitic alloys to a special treatment.

b. Novel Ni—Al or Ni—Al-Co alloys can provide metal articles having an especially excellent repeatedly reversible shape memory effect and other metallurgical properties.

Therefore, one object of the present invention is to provide metal articles having a repeatedly reversible shape memory effect and a process for preparing the same.

Another object of the present invention is to provide novel Ni—Al and Ni—Al—Co alloys suitable for preparing metal articles having the said repeatedly reversible shape memory effect.

"Repeatedly reversible shape memory effect" (hereinafter abbreviated as RSM effect) referred to in this invention means a faculty by which any alloy can perfectly or partially and reversibly and repeatedly regain both of the shapes before and after deformation (i.e. undeformed shape and deformed shape, respectively) or plastic strain when cooled down and heated up.

An RSM effect according to the present invention will be described below in more detail with reference to the appended drawings, in which.

A process for preparing metal articles having an RSM effect according to the present invention is characterized by comprising applying a deformation stress to a β-brass type martensitic alloy at a temperature below Md point, with the value of said deformation stress being within such a range as exceeding the first yield point of martensite crystal in the said alloy beyond the easy plastic flow region but below the point at which a large amount of permanent strain is produced by glide deformation.

Treatments necessary for preparing metal articles having an RSM effect from a β-brass type martensitic alloy comprise deforming the alloy below Md point [i.e. the highest temperature at which a martensite phase is formed by deforming the metastable mother phase (high temperature phase) obtained by a quenching step], preferably below Ms point (the temperature at which a martensite phase begins to be formed of itself) and more preferably below Mf point (the temperature at which whole of the alloy is transformed into martensite), and making the deformation stress exceed a predetermined value.

Consequently it should be noted that in the process for preparing metal articles having an RSM effect according to the present invention, deformation stress is, on principle, applied to the alloy in martensite phase.

Figure 1:
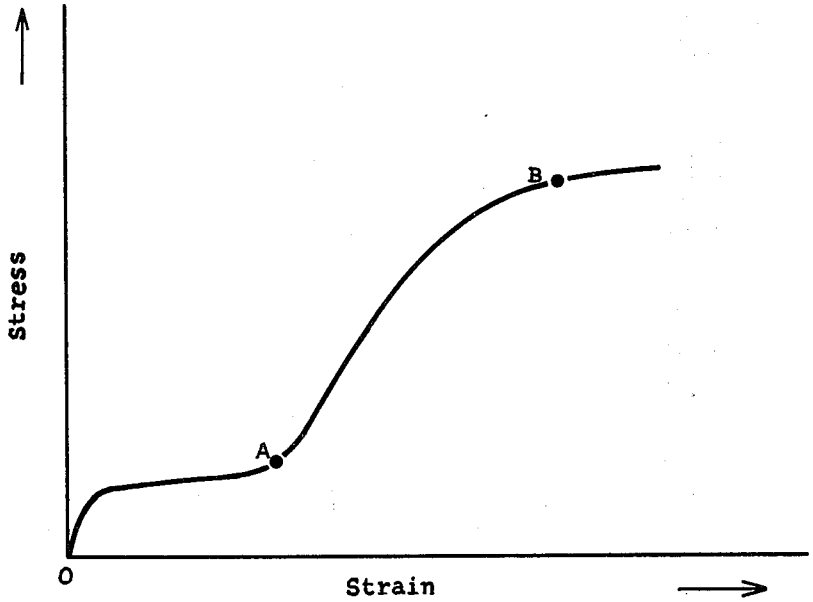
FIG. 1 is a view representing a stress-strain characteristic curve in fully martensitic state of a β-brass type martensitic alloy.

The predetermined value of the deformation stress applied to the alloy is in the range exceeding the first yield point of martensite crystal in the alloy beyond the easy plastic flow region but below the point at which a large amount of permanent strain is produced by glide deformation, that is, between points A and B in FIG. 1. By heating the said deformed alloy above As point (i.e. the point at which a high temperature phase begins to be formed of itself) or Af point (i.e. the point being completely reversely changed to a high temperature phase), the alloy partially or perfectly regains the undeformed shape (original shape). By cooling again the alloy below Ms point and further Mf point, the alloy is changed again into martensite phase and returns wholly or partially to the deformed shape. Thus, metal articles having an RSM effect can repeatedly regain both undeformed and deformed shapes when cooled down and heated up, respectively. The said deformation may involve any permanent deformation e.g. by bending, twisting, tension, compression, rolling, drawing or swaging.

As abovementioned, the essence of the process for preparing metal articles according to the present invention consists in that the alloy is provided with a deformation stress within a specified range and that the deformation is, on principle, applied to the alloy in martensite phase.

If such a small amount of deformation as only approximately the first yield point is applied, the original shape is regained only one time, and repeatedly reversible shape memory (RSM) effect does not appear. Further, if most of the deformation is plastic deformation by gliding (in the region exceeding point B in FIG. 1), the original shape is hardly regained, thus failing to obtain the RSM effect.

As abovementioned, in the process using an alloy according to the present invention, a specified amount of deformation is applied to the alloy, the reason for which is considered as the following.

According to the present invention, when a β-brass type electron compound alloy (β-brass type martensitic alloy) in the martensite phase is deformed, the plastic deformation proceeds not by gliding, unlike the case of ordinary metal or alloys.

That is, the deformation is carried out in two ways, that is, (1 ) twin deformation in the martensite phase and (2) deformation based on the formation of a new martensite phase (stress-induced martensitic transformation), the latter consisting of two kinds — one being the case in whch a martensite phase different in its structure from the original martensite phase is formed, and the other being the case in which the original martensite phase is deformed without changing its structure but so as to be orientated in specific directions. When the amount of the deformation is small as abovementioned (near the first yield point) the RSM effect does not appear, while when it exceeds the said limitation the strain is stored in the mother phase part even after a reverse transformation and such a strain stored during the successive cooling triggers the formation of martensite phase in the direction returning the shape to the deformed one. If the amount of the deformation exceeds the said upper limit not in the mode (1) or (2) above but accompanied with a large amount of glide deformation, the restoration of the original shape becomes more difficult as the deformation increases in amount, possibly resulting in the failure in obtaining the RSM effect.

Most of the conventional β-brass type martensitic alloys can be used as a starting material in the process for preparing metal articles having an RSM effect according to the present invention. Preferred examples of β-brass type martensitic alloys according to the present invention are alloys e.g. Ni—Al, Ni—Al—Co, Ni—Al—Ga, Ni—Al—Zn, Ni—Al—Ti, Ti—Ni, Ti—Co, Ti—Fe, Ni—Ti—V, Ti—Ni—Cr, and Ni—Ti—Mn, quaternary system alloys (including Ni, Pd, Ti and Zr) and alloys e.g. Cu—Zn, Cu—Zn—Ga, Cu—Zn—Al, Cu—Zn—Sb, Cu—Zn—Sn, Cu—Al, Cu—Al—Ni, Cu—Al—Co and the like. In all of these alloys, the transition from high temperature phase (β-phase) to low temperature phase (martensite phase) occurs in a reversible manner.

The inventors have succeeded in preparing novel Ni—Al alloy and Ni—Al—Co alloy suitable for preparing metal articles having an RSM effect and excellent in other metallurgical properties, as above-mentioned.

The composition range and metallurgical characteristics of the novel Ni—Al alloy and Ni—Al—Co alloy and a process for preparing the same are now described below in detail.

A. Ni—Al alloy:

Ni 55–65 at %

Al the remainder

Ms point −273° to 300° C

A preferred process for preparing the said alloy comprises;

1. a step of melting the starting material having the abovementioned composition in a vacuum or an appropriate atmosphere (e.g. in argon gas) and slowly solidifying the same, 2. a step of homogenizing the ingot obtained by the said melting step and thus obtaining a coarse grained alloy or a single crystal alloy with respect to the β-phase (the mother phase), and 3. a quenching step comprising taking the single crystal or coarse grained part of the mother phase of the obtained alloy, heat-treating the same above 1000° C but below melting point of the alloy and then cooling (e.g. water cooling) the same.

According to the present invention, the most preferred process comprising melting, slow-solidifying and homogenizing steps comprise slowly cooling the melt still in a crucible without moulding the same in a mould, and then heat-treating the ingot obtained at about 1100° – 1400° C for a few days.

According to the abovementioned process, coarse grained and single crystal alloys are obtained. These alloys are, needless to say, extremely excellent in their metallurgical properties and the RSM effect.

For example, a Ni—Al single crystal alloy according to the present invention can exert the RSM effect extremely perfectly and at a high accuracy, and show excellent metallurgical properties e.g. durability, toughness and particularly workability thereof.

Other processes for preparing a coarse grained alloy or a single crystal alloy including a homogenizing step are as follows. One process comprises melting the starting material in an appropriate atmosphere (e.g. argon gas), forming the molten material into a coarse grained alloy or a single crystal alloy by unidirectional solidification or Bridgman's method et al., taking a coarse grained part or single crystal from the mother phase (high temperature phase or β′-phase), heat-treating the same above 1000° C but below melting point of the alloy and cooling the same.

The percentage composition of the alloy for providing the remarkable RSM effect preferably ranges 62–65 at % of Ni and the remainder Al. Alloys in this range can all provide the best RSM effect.

When after obtaining the martensite phase by water cooling or by further cooling to a lower temperature after the said water cooling, deformation beyond the easy plastic flow region is applied to the said alloy, the alloy shows an extremely excellent RSM effect. Further, it has been also proved that a method for applying deformation to a relatively brittle alloy comprises applying a preliminary deformation e.g. by rolling and then a final deformation in a different manner e.g. by bending, twisting or the like, achieves an excellent RSM effect.

Generally, the said preliminary deformation or prestrain is applied to the alloy in a different direction from that of the final deformation, the strain amount being preferably below about 5% in general.

As the percentage composition of an alloy changes, Ms and Af points change. For example, Ms and Af points of an alloy including 61 at % Ni and the remainder Al are about −200° and −180° C respectively, while Ms and Af points of an alloy including 65 at % Ni and the remainder Al are about 300° and 320° C, respectively. In this percentage composition range, both of the Ms and Af points change rectilineally with respect to Ni at %.

Consequently, by appropriately selecting a percentage composition of the alloy the temperature range can be freely changed in which the RSM phenomenon occurs.

In case of an alloy consisting of 61–65 at % Ni and the remainder Al, the RSM phenomenon can be used in the temperature range of −200° C to 300° C. This phenomenon is not only widely used in the engineering field e.g. for switching according to the temperature rise or drop, but also has an advantage of being usable for a long time and in a stable state because of its corrosion resisting and heat resisting properties.

Figure 2:
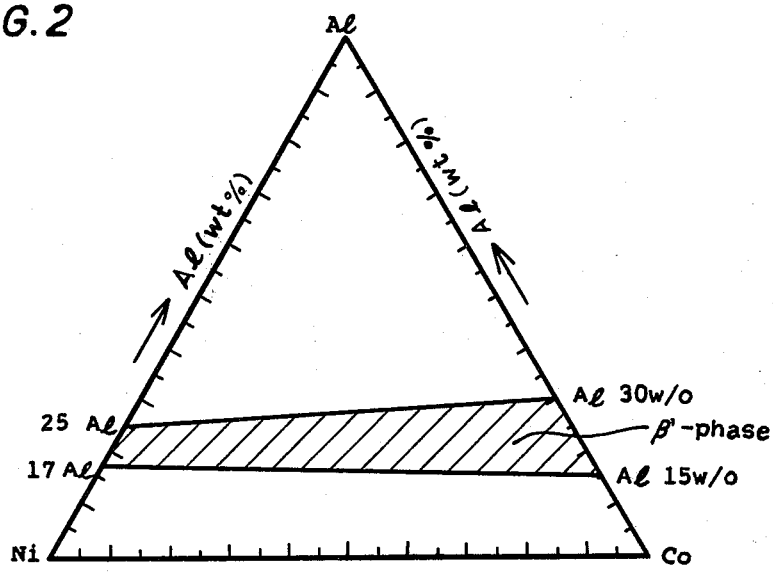
FIG. 2 is a view representing a state of a Ni—Al—Co alloy.

B. Ni—Al—Co alloy:

An alloy having the RSM effect can be obtained by substituting with Co a part or the whole of Ni in the alloy in the preceding item (A). The percentage composition range of this alloy is shown in FIG. 2. This alloy also exerts an excellent RSM effect. Further, by adding Co, Ms point is raised and the workability of the alloy is increased.

The process for producing this coarse grained or single crystal alloy is the same as in the preceding item (A).

The abovementioned two kinds of novel Ni—Al and Ni—Al—Co alloys have more excellent hardness property and thus a highly accurate RSM effect in comparison with other conventional β-brass type martensitic alloys, so that they are suitable for every kind of engineering applications, especially precision engineering applications.

Further, impurities and/or other elements may be added to the composition of the abovementioned alloys so as to change their characteristics so long as the martensitic transformation is not hindered.

As apparent from the description above, the metal articles having the RSM effect and the said novel alloys have extremely important industrial properties. For example, when metal articles comprising the alloys having the RSM effect according to the present invention is used as heat sensitive elements, the elements can be repeatedly used and will extremely accurately repeat the reversible transition between the original shape and the deformed shape, unlike the conventional metal articles or alloys having a unidirectional shape memory effect, thus affording precise measurements. Further, since metallurgical properties e.g. Ms and As points of the alloys constituting the metal articles according to the present invention can be widely changed by selecting their composition and composition range as abovementioned, metal articles or alloys suitable for any purpose can be easily obtained. Still further, since Ms(Mf) and As(Af) points of the alloy constituting the metal articles according to the present invention depend upon the external force e.g. pressure, the alloy can be also used for a pressure sensitive element.

For example, the metal articles according to the present invention are applied to a switching device. In this case, the metal article functions as a switching body for sensing the temperature. Further, by incorporating the metal articles according to the present invention into any of the devices for electrically, magnetically and optically sensing the shape (length, thickness, angles or the like) of the metal articles or alloys having the RSM effect, e.g. a differential transformer, a condenser, a magnetic sensitive device and an optical lever, the temperature and the pressure can be sensed.

The alloys or metal articles according to the present invention which can be repeatedly used over a wide temperature range has a strikingly broad applications in comparision with the conventional ones.

Further, the alloys according to the present invention or Ni—Al and Ni—Al—Co alloys have a high resistance to chemicals e.g. resistance to oxidization or to acid and are sufficiently usable in an oxidizing atmosphere or in an acid, so that a chemical plant is possibly a promising field for applying the same.

The present invention is now described in more detail on the basis of the following unlimited examples.

EXAMPLE 1

Ni—Al alloy

Ni 63.2 at %, Al the remainder
Ms point about 50° C, Af point 70° C

An alloy having the abovementioned composition was prepared by melting the same in a vacuum and then cooled gradually. After the cooling the ingot was heat-treated (homogenized) at about 1300° C for three days and a coarse grained alloy was obtained, from which a single crystal alloy having about 3–5cm diameter is then obtained.

Figure 3:
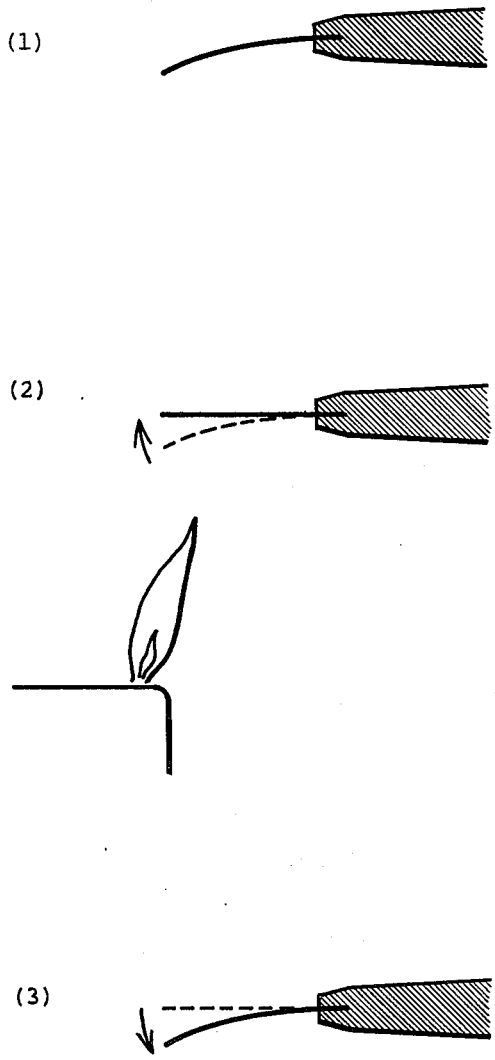
FIG. 3 is an explanatory view of the result of an RSM effect experiment in Example 1.

By water-cooling (quenching) from 1250° C a plate of the single crystal alloy having 0.3mm thickness, the alloy in the martensite phase was obtained. By subjecting the alloy to prestrain by cold-rolling of about 3% at room temperature and thereafter bending (with the curvature radius of about 20mm), metal articles having the RSM effect were obtained. When heated above its Af point, the metal articles regained the original shape perfectly (at 100% restoration ratio). Then by cooling the same below its Af point, it returned to the bent state having about 24mm curvature radius. After that, in correspondence with the heating-cooling cycles, the bent status perfectly repeatedly appeared. FIG. 3 is a view for explanation of this example.

FIG. 3–1

A plate perfectly transformed into the martensite by quenching the alloy from 1300° C in ice water was rolled about 3% at room temperature. The plate was bent as shown in FIG. 3–1.

FIG. 3–2

The specimen was heated in a flame of a gas lighter (then the temperature was above its Af point). The plate regained the original shape before bending.

FIG. 3–3

The specimen was cooled in the air to room temperature. Its shape returned to the bent state at room temperature again.

The shapes as shown in FIGS. 3–2 and 3–3 can be repeatedly regained by repeating the rise and drop of the abovementioned temperatures.

In the subject example it is not preferred that the amount of rolling as prestrain exceeds 5%. For obtaining the best RSM effect, in case of bending deformation, preferably preliminary rolling below 3% is applied.

Further, in case of applying deformation by compression, the same RSM effect as abovementioned was obtained. In case of deformation by compression, the deformation amount enough to provde the RSM effect needs to exceed the point A in FIG. 1. Such a deformation amount possibly changes according to the crystal orientation, the specimen size and the composition. In case of a 4×4×7mm specimen comprising an alloy containing 64.0 at % Ni and the remaining Al taken as an example, the deformation amount was about 5%. When the deformation amount is below this value, the RSM effect is decreased or substantially disappears.

Further, this alloy is generally regarded as brittle, but it has been proved that this brittleness is mainly due to the presence of the grain boundaries of the mother phase (high temperature phase), and consequently by using the single crystal part in the mother phase (high temperature phase) excellent workability can be achieved. Therefore, in order to obtain metal articles comprising a Ni—Al alloy having a stable RSM effect, preferably the single crystal in the mother phase is used.

EXAMPLE 2

Ni—Al—Co alloy

Ni 63.8 at %, Co 1.0 at %
Al the remainder
Ms point about 200° C,
As(or Af) point about 780° C A metal article having the RSM effect comprising a single crystal alloy was produced in the similar manner to that of Example 1.

This metal article is obtained by subjecting a flat bar shaped specimen comprising the said single crystal alloy to bending deformation at room temperature without any specific prestrain according to the said method of the present invention. When heated above the transformation point, the subject metal article perfectly regained the original shape and when cooled again, it substantially perfectly regained the deformed shaped. According to the subsequent reversible heating-cooling cycles, transformation between the original and deformed shapes were perfectly repeatedly effected.

It has been provided that when Co is added as a third element, Ms point rises and workability of the martensite increases, Therefore, in case of this alloy, a prestrain as applied in Example 1 need not be specially applied for the purpose of preventing brittle fracture. However, even in case of this alloy, the application of such a prestrain does not hinder but still improves the RSM effect.

Depending upon the Co content, the martensite phase is sometimes decomposed below Af point (bainite like structure). For example, in case of an alloy of the abovementioned composition, ageing at 300° C for 10 minutes effect such decomposition. In this case, therefore, preferably the working temperature of the metal article having the RSM effect is below 300° C. The memory temperature in this case is about 280° C.

Further, in case of this alloy, it is preferable to use the single crystal or coarse grained part of the mother phase, similarly to Example 1.

What we claim is:

1. A process for preparing metal articles having a property of repeatedly reversible shape memory effect, comprising applying deformation stress to a $\beta$-brass type martensitic Ni-Al alloy consisting essentially of 55–65 at % of Ni and the remainder of Al at a temperature below Md point, in which the value of said deformation stress is within a range exceeding the first yield point of martensite crystal in said alloy beyond easy plastic flow region but below the point at which a large amount of permanent strain is produced by glide deformation.

2. A process as claimed in claim 1, comprising applying said deformation stress to said alloy at a temperature below Ms point.

3. A process as claimed in claim 1, comprising applying said deformation stress to said alloy at a temperature below Mf point.

4. A process as claimed in claim 1, in which prestrain is preliminarily applied to said alloy in a different direction from that of the final deformation.

5. A process as claimed in claim 4, in which the prestrain amount is below 5%.

6. A process as claimed in claim 1, in which said Ni-Al alloy is a coarse grained or single crystal alloy.

7. A metal article having a property of providing a repeatedly reversible shape memory effect prepared by the process of claim 1.

8. A metal article having a property of providing a repeatedly reversible shape memory effect prepared by the process of claim 5.

9. A metal article having a property of providing a repeatedly reversible shape memory effect prepared by the process of claim 6.

10. A process for preparing coarse grains or single crystal of $\beta$-brass type (Ni, Co) Al alloy having the composition range as shown in FIG. 2 of the appended drawings, comprising the steps of melting starting material having said composition in a vacuum or an appropriate atmosphere, solidifying slowly the melt for promoting the formation of coarse grains or single crystals in $\beta'$-phase of the alloy, homogenizing the ingot at about 1100°–1400° C for a few days, and heat-treating the coarse grains or single crystals obtained from the ingot at a temperature below the melting point of the alloy and then rapidly cooling the same.

11. A process as claimed in claim 1, in which prestrain is preliminarily applid to said alloy in a different direction from that of the final deformation.

12. A process as claimed in claim 11, in which the prestrain amount is below 5%.

13. A process for preparing metal articles having a property of repeatedly reversible shape memory effect, comprising applying deformation stress to a $\beta$-brass type martensitic Ni—Al—Co alloy having a composition range as shown in FIG. 2 of the appended drawings at a temperature below Md point, in which the value of said deformation stress is within a range exceeding the first yield point of martensite crystal in said alloy beyond easy plastic flow region but below the point at which a large amount of permanent strain is produced by glide deformation.

14. A process as claimed in claim 13 comprising applying said deformation stress to said alloy at a temperature below Ms point.

15. A process as claimed in claim 13 comprising applying said deformation stress to said alloy at a temperature below Mf point.

16. A process as claimed in claim 13, in which prestrain is preliminarily applied to said alloy in a different direction from that of the final deformation.

17. A process as claimed in claim 16, in which the prestrain amount is below 5%.

18. A process as claimed in claim 13, in which said alloy is a coarse grained or single crystal alloy.

19. A process as claimed in claim 18, in which prestrain is preliminarily applied to said alloy in a different direction from that of the final deformation.

20. A process as claimed in claim 19 in which the prestrain amount is below 5%.

21. A metal article having a property of providing a repeatedly reversible shape memory effect prepared by the process of claim 12.

22. A metal article having a property of providing a repeatedly reversible shape memory effect prepared by the process of claim 13.

23. A metal article having a property of providing a repeatedly reversible shape memory effect prepared by the process of claim 17.

24. A metal article having a property of providing a repeatedly reversible shape memory effect prepared by the process of claim 18.

25. A metal article having a property of providing a repeatedly reversible shape memory effect prepared by the process of claim 20.

* * * * *